US009123224B2

(12) United States Patent
Hall et al.

(10) Patent No.: US 9,123,224 B2
(45) Date of Patent: Sep. 1, 2015

(54) MOBILE PERIMETER ACCESS SECURITY SYSTEM

(75) Inventors: Kevin Hall, Westerville, OH (US); Michael Green, Delaware, OH (US)

(73) Assignee: Jobsite Resources, LLC, Westerville, OH (US)

( * ) Notice: Subject to any disclaimer, the term of this patent is extended or adjusted under 35 U.S.C. 154(b) by 513 days.

(21) Appl. No.: 13/150,741

(22) Filed: Jun. 1, 2011

(65) Prior Publication Data

US 2012/0306651 A1 Dec. 6, 2012

(51) Int. Cl.

*G08B 13/14* (2006.01)
*G08B 13/196* (2006.01)
*G08B 13/24* (2006.01)

(52) U.S. Cl.

CPC .... *G08B 13/19673* (2013.01); *G08B 13/19695* (2013.01); *G08B 13/19697* (2013.01); *G08B 13/248* (2013.01); *G08B 13/2454* (2013.01)

(58) Field of Classification Search

CPC . G06K 7/0008; G06K 19/0723; G06Q 10/08; G08B 13/196673; G08B 13/19695; G08B 13/19697; G08B 13/2454
USPC ..... 340/572.1; 70/57.1
See application file for complete search history.

(56) References Cited

U.S. PATENT DOCUMENTS 5,745,036 A * 4/1998 Clare ..... 340/572.1
7,086,558 B1 8/2006 Pixley et al.
7,317,393 B2 1/2008 Maloney
7,337,963 B2 3/2008 Harper et al.
7,371,977 B1 5/2008 Preonas
2001/0035410 A1 11/2001 Taube et al.
2002/0089434 A1 * 7/2002 Ghazarian ..... 340/988
2004/0150525 A1 * 8/2004 Wilson et al. ..... 340/572.1
2004/0164864 A1 * 8/2004 Chung et al. ..... 340/572.7
2006/0103520 A1 5/2006 Clark
2006/0107614 A1 * 5/2006 Slagel ..... 52/750
2007/0018826 A1 * 1/2007 Nowak et al. ..... 340/572.1
2007/0108273 A1 5/2007 Harper et al.

(Continued)

OTHER PUBLICATIONS

Autocrib, Inc., AutoCrib Website Pages, http://www.autocrib.com/ Intelliport, Apr. 27, 2009, 6 pages.

(Continued)

*Primary Examiner* — George Bugg
*Assistant Examiner* — Anthony D Afrifa-Kyei
(74) *Attorney, Agent, or Firm* — Taft Stettinius & Hollister, LLP; Stephen F. Rost

(57) ABSTRACT

A mobile security system is provided having a container configured to be moved to a plurality of locations. A walkway extends transversely through the container and provides access to an exit gate when the mobile security system is positioned adjacent an exit gate. The mobile security system includes a RFID detection system for detecting and identifying RFID tags that move through the walkway. If a RFID tag associated with a jobsite item is identified, an alarm system and/or camera devices within the container are actuated. The electronic components of the mobile security system are stored in a primary cabinet in the container so as to be inaccessible from the walkway. The container is configured to prevent damage to the electronic components caused by movement, vibration, or harsh environmental conditions.

11 Claims, 11 Drawing Sheets

(56) References Cited

U.S. PATENT DOCUMENTS

| | | | | |
|---|---|---|---|---|
| 2007/0115127 | A1 | 5/2007 | Harper et al. | |
| 2007/0290849 | A1* | 12/2007 | Tuttle | 340/572.1 |
| 2008/0100416 | A1 | 5/2008 | Harper et al. | |
| 2008/0164311 | A1* | 7/2008 | Harper et al. | 235/385 |
| 2008/0165013 | A1 | 7/2008 | Harper et al. | |
| 2008/0246613 | A1* | 10/2008 | Linstrom et al. | 340/572.4 |
| 2008/0250726 | A1* | 10/2008 | Slagel et al. | 52/79.8 |
| 2009/0033154 | A1* | 2/2009 | Linkhart et al. | 307/65 |
| 2010/0289626 | A1* | 11/2010 | Oberle et al. | 340/10.42 |
| 2011/0106681 | A1* | 5/2011 | Cockerell et al. | 705/35 |

OTHER PUBLICATIONS

Dropbox, Inc., DropBox Website Pages, http://www.dropboxinc.com, Apr. 27, 2009, 4 pages.

Dropbox, Inc., Drop Box Brochure from Website, http://www.dropboxinc.com, 2 pages.

Stanley Black & Decker, Inc., CribMaster Website Pages, http://www.cribmaster.com, Apr. 27, 2009, 3 pages.

U.S. Patent and Trademark Office; Office Action in U.S. Appl. No. 12/432,361 dated Nov. 30, 2011, 12 pages.

* cited by examiner

MOBILE PERIMETER ACCESS SECURITY SYSTEM

FIELD OF THE INVENTION

The invention is generally related to monitoring and tracking objects, and more particularly, to systems, devices and methods for monitoring and tracking objects in a controlled space such as a jobsite.

BACKGROUND OF THE INVENTION

Companies typically have difficulties tracking jobsite items (including tools, equipment, instruments, parts, components, direct materials, etc.) and their usage within their facilities. Many jobsite items are misused, misplaced, and improperly tracked and replenished by the employees of the companies. For example, the General Contractors of California report that 85% of all jobsite item thefts are employee-related. Losing these jobsite items adversely affects the operation of a jobsite in various ways, including but not limited to monetary loss, project delays, loss production, duplicate orders, increased administrative cost, and increased insurance premiums.

The problem escalates when outside of a controlled environment such as a facility. Jobsite equipment and inventory theft is significant with industry loss estimates up to one billion dollars annually, according to a 2003 National Equipment Register study. Tool tracking and management systems provide one level of security, but a large percentage of theft includes jobsite items disappearing from jobsites at the end of the workday. Generally, only limited resources may be allocated to management of jobsite items at the perimeter of a controlled space such as a facility or an outdoor temporary worksite. Although manned jobsite perimeter security and personal inspection of workers is one option, providing the dedicated resources for such manned security is usually too costly to be considered. With many jobsites operating with aggressive deadlines on a 24-hour per day schedule, providing a security guard at every exit for multiple shifts throughout the day and night is not a viable option. Furthermore, manual inspection of workers would severely bottleneck exiting personnel during a shift change or other heavy traffic times, leading to further inefficiencies in the process.

Some contemporary solutions to this problem include security portals activated by special electronic article surveillance ("EAS") security tags. Similar to retail environments, in practice, the portal sounds an alarm when an EAS tagged jobsite item passes through it. These portals must generally be carefully set up and aligned properly at every entry and exit point of a jobsite to ensure that accurate detection of the EAS security tags occurs. This set up process is time consuming and expensive, and is not a reasonably effective option for preventing jobsite item theft at temporary jobsites such as construction jobsites. Moreover, these portals may be significantly affected by harsh environmental conditions at a jobsite and become inoperable or damaged during use. Furthermore, these solutions still lack the tracking and access control that is beneficial on a jobsite with combinations of employees and contractors, as well as ease and portability of the secured area.

In another example, some jobsites store high-value jobsite items in a further controlled space with electronic access control systems configured to limit exposure of such jobsite items to certain personnel. However, these systems generally do not track inventory or other jobsite items on an individual level, and any tracking that is conducted is usually performed manually. These arrangements still do not solve the problem of jobsite item theft and add more inefficiencies to the security process.

Therefore there is a need in the art for a system, apparatus and method that detects and discourages jobsite item theft or unauthorized removal, which is conveniently portable and insulated from harsh environmental conditions.

SUMMARY OF THE INVENTION

Embodiments of the invention provide a mobile security system for a jobsite including a container, which is configured to be readily moved to a plurality of locations. The container is rugged or industrial-grade and includes a housing having first and second end walls and first and second side walls extending between the first and second end walls. The container also includes an interior within the housing and a walkway extending transversely through the housing and through the first and second end walls. A radio frequency identification (RFID) detection system is associated with the container. The RFID detection system includes at least one RFID antenna that detects RFID tags passing through the walkway, and a RFID reader that identifies an RFID tag associated with a jobsite item that are detected by the at least one RFID antenna. For example, the RFID detection system operates as an automatic identification and data capture system. The mobile security system also includes an alarm system associated with the container and producing a visible and/or audible signal when a RFID tag associated with a jobsite item is identified by the RFID reader. The RFID detection system also includes one or more IP cameras that photograph personnel moving through the container whenever motion is detected by the IP cameras. The RFID tag information and photographs are stored in local memory or transmitted to a central security system, and the relevant security or management personnel may be notified immediately via e-mail or other electronic communication methods. In this regard, the mobile security system is a comprehensive security system for any jobsite.

An uninterruptible power supply (UPS) is operable to provide power to the RFID detection system and the alarm system. A central processing unit (CPU) may be operatively coupled to the alarm system and the RFID detection system, thereby controlling the actuation of the alarm system when the RFID detection system identifies a RFID tag associated with a jobsite item. The container includes a primary cabinet positioned alongside the walkway in the interior of the container, the primary cabinet holding the RFID antenna, the RFID reader, the UPS, and the CPU. The primary cabinet is positioned such that access into the primary cabinet from the walkway is prevented. The primary cabinet is configured to prevent unauthorized tampering with the electronic components of the mobile security system and is also configured to prevent damage to these electronic components that may be caused by vibrations and movement of the container. The rugged container also prevents damage to the electronic components caused by harsh environmental conditions at a jobsite. To this end, the mobile security system is a turnkey solution which requires no on-site assembly and is durable enough to withstand harsh jobsite environments, whether at a facility or outdoors.

In one embodiment, the container of the mobile security system may be moved in front of an exit gate of the jobsite such that the exit gate is only accessible through the walkway. As people walk through the walkway to access the exit gate, the RFID detection system scans those people in the walkway and identifies any RFID tags associated with a jobsite item carried by those people. If such a RFID tag is identified, the alarm system is actuated to produce an audible and/or visible signal to deter or prevent removal of that jobsite item from the jobsite. People walking through the container also activates the motion-sensitive IP cameras in the container, which record photographic or video evidence of every person leaving the jobsite. Furthermore, an e-mail notification is triggered and sent to designated security or management personnel to report any incident. The container may then be moved to another exit gate or another jobsite without requiring a new assembly of all the electronic components. At the completion of a project, the mobile security system can be transported to the next site without requiring any downtime for re-assembly. The mobile security system provides a comprehensive, rugged, industrial-strength, turnkey solution to jobsite security and jobsite item theft problems.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
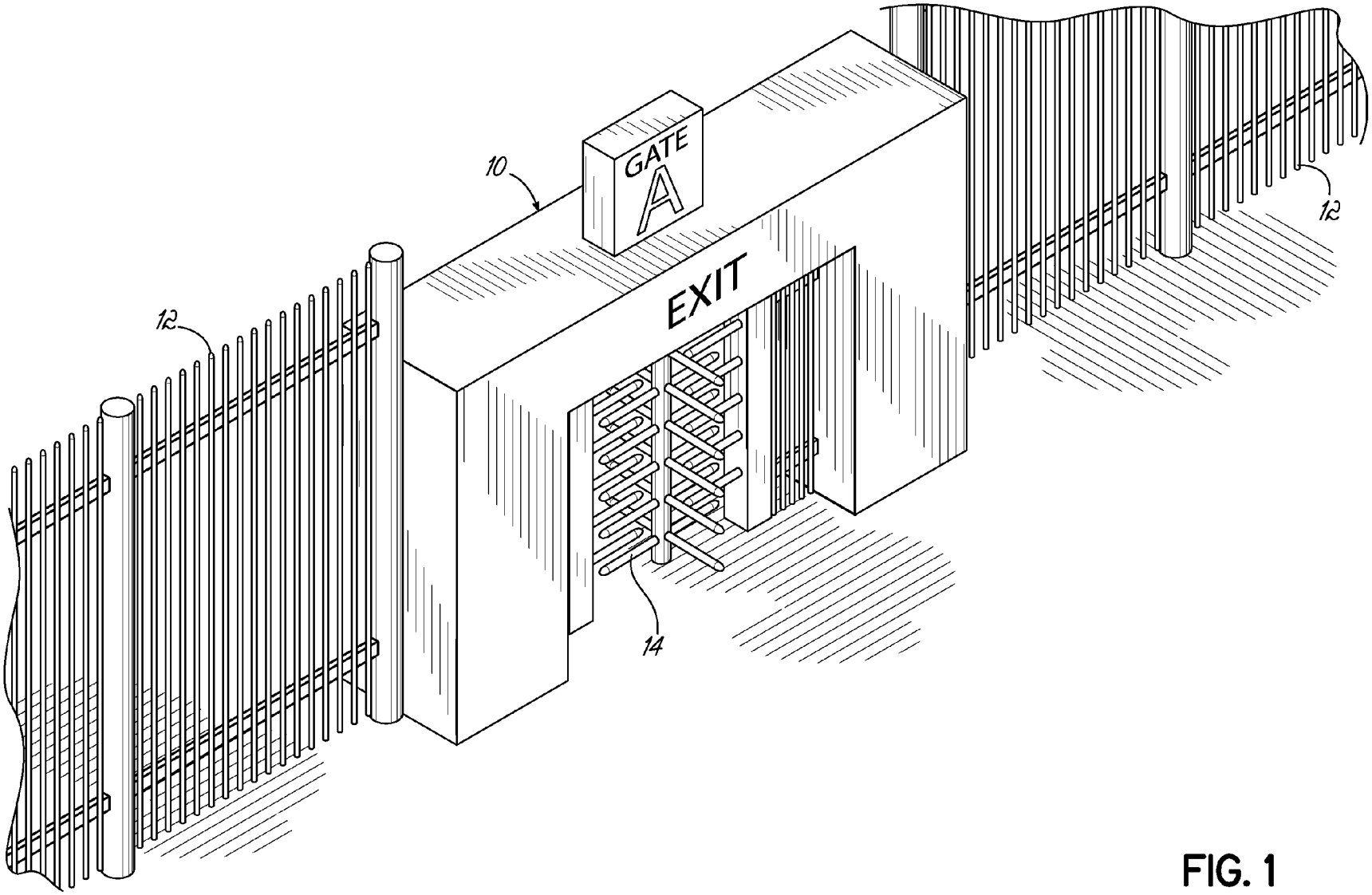
FIG. 1 is a perspective view of an exit gate of a typical controlled space such as a jobsite.
Figure 2:
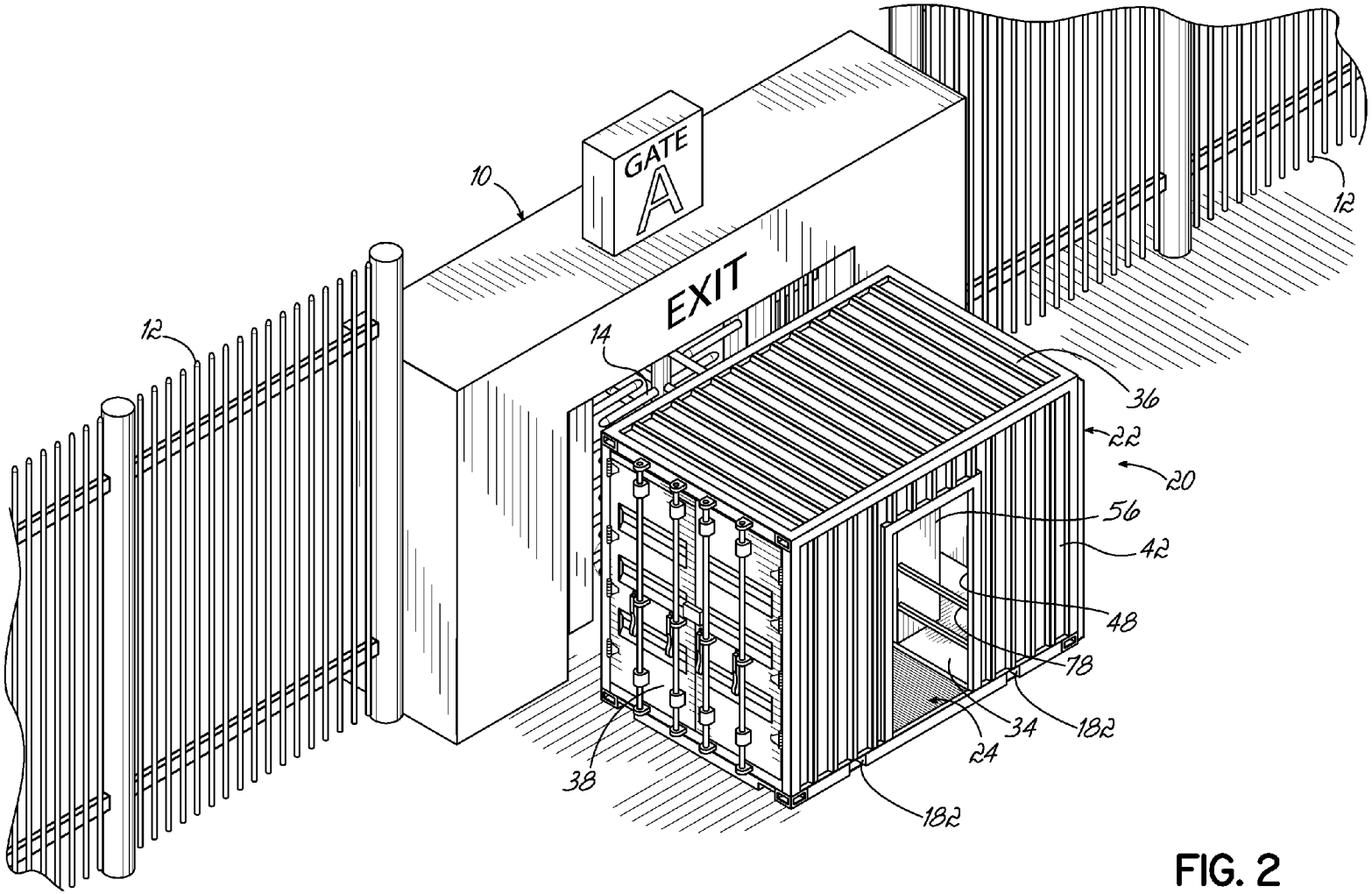
FIG. 2 is a perspective view of the exit gate of FIG. 1 with an exemplary embodiment of a mobile security system according to the present invention, placed in front of the exit gate.

Embodiments of the invention provide a mobile perimeter access security system that utilizes radio frequency identification ("RFID") to secure exit gates or portals of a controlled space such as a jobsite. As seen generally in FIG. 1, a jobsite may include one or more exit gates 10 providing access through a fence 12 or other barrier surrounding the jobsite. The exit gate 10 typically includes one or more turnstiles 14 configured to permit controlled passage into and out of the jobsite. As shown in FIG. 2, a mobile security system 20 may be implemented in a container 22, such as a shipping container, though other sized containers and trailers may also be used depending on the space requirements needed for the controlled access (i.e., how many turnstiles 14 are located in parallel at a particular exit gate 10). The mobile security system 20 may be moved as a unit to the position shown in FIG. 2, directly in front of or occluding the exit gate 10. The container 22 includes one or more walkways 24 which define a pathway for workers and other personnel to access the turnstiles 14 and exit the jobsite. In this regard, every person leaving the jobsite must pass through the container 22 of the mobile security system 20 on their way out of the jobsite.

In general operation of any of the implementations of the mobile security system 20, as a person steps into the walkway 24 of the container 22, a RFID detection system 26 scans the person to detect any RFID tags moving through the container. If the RFID detection system 26 detects any such RFID tags, the detected RFID tags are compared to a database of RFID tags associated with jobsite items including but not limited to tools, equipment, instruments, parts, components, and inventory. If the RFID detection system identifies a detected RFID tag as being associated with a jobsite item, an alarm system 28 within the container 22 is actuated to produce an audible and/or visual signal indicating the removal of a jobsite item from the jobsite. A camera device 30 may also be actuated to photograph the person in the walkway 24 upon sensing motion inside the container 22. The person may then be stopped at the turnstile 14 of the exit gate 10 or later identified by the photographs after passing through the exit gate 10 so that the jobsite items may be returned or replaced to the jobsite. To this end, the mobile security system 20 detects and prevents unauthorized removal and theft of jobsite items. Furthermore, the mobile security system 20 is a turnkey security solution that is rugged enough for industrial settings, completely mobile, and requires no installation or setup after moving to a new site.

Figure 3:
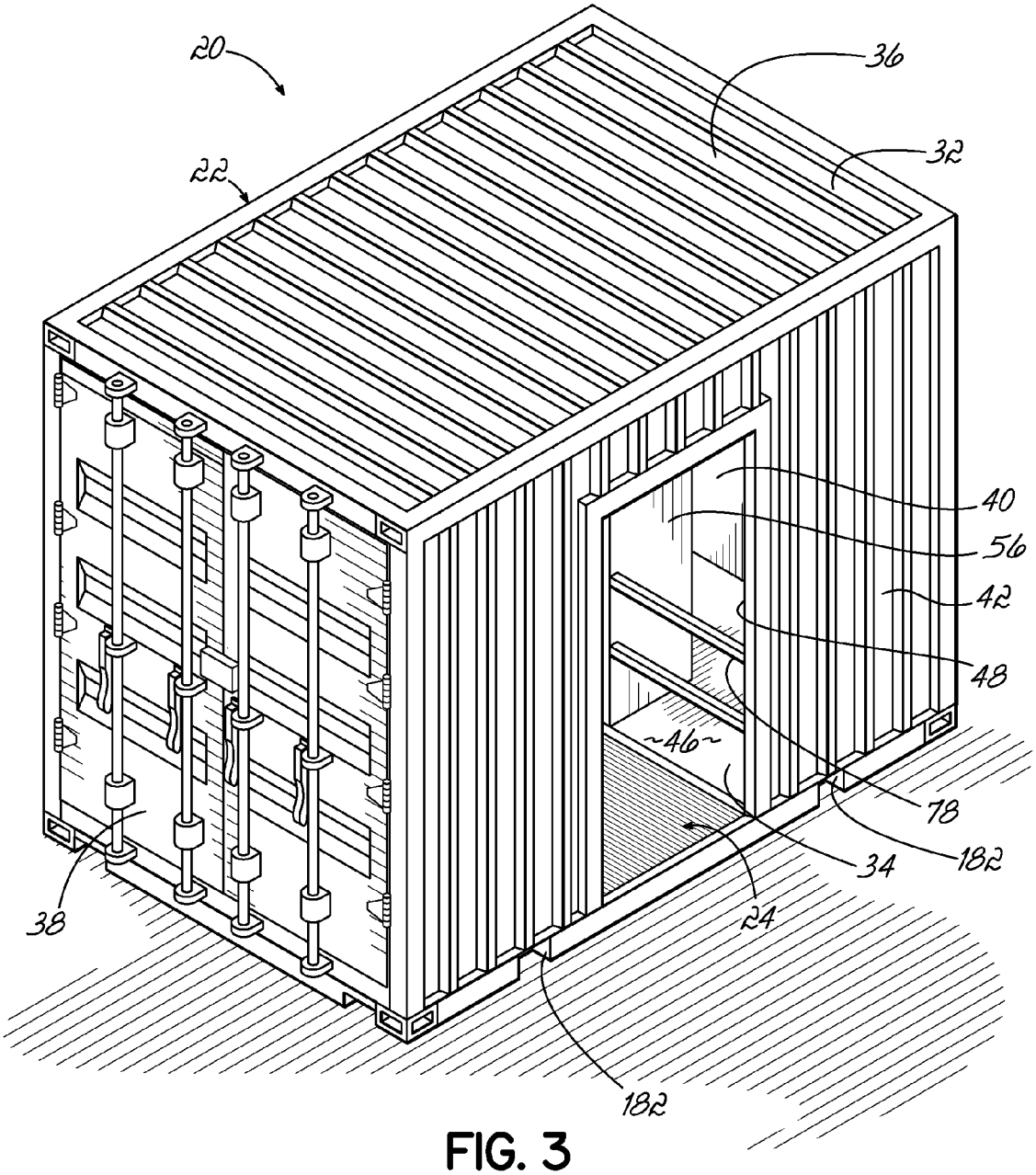
FIG. 3 is a perspective view of the mobile security system of FIG. 2.
Figure 4:
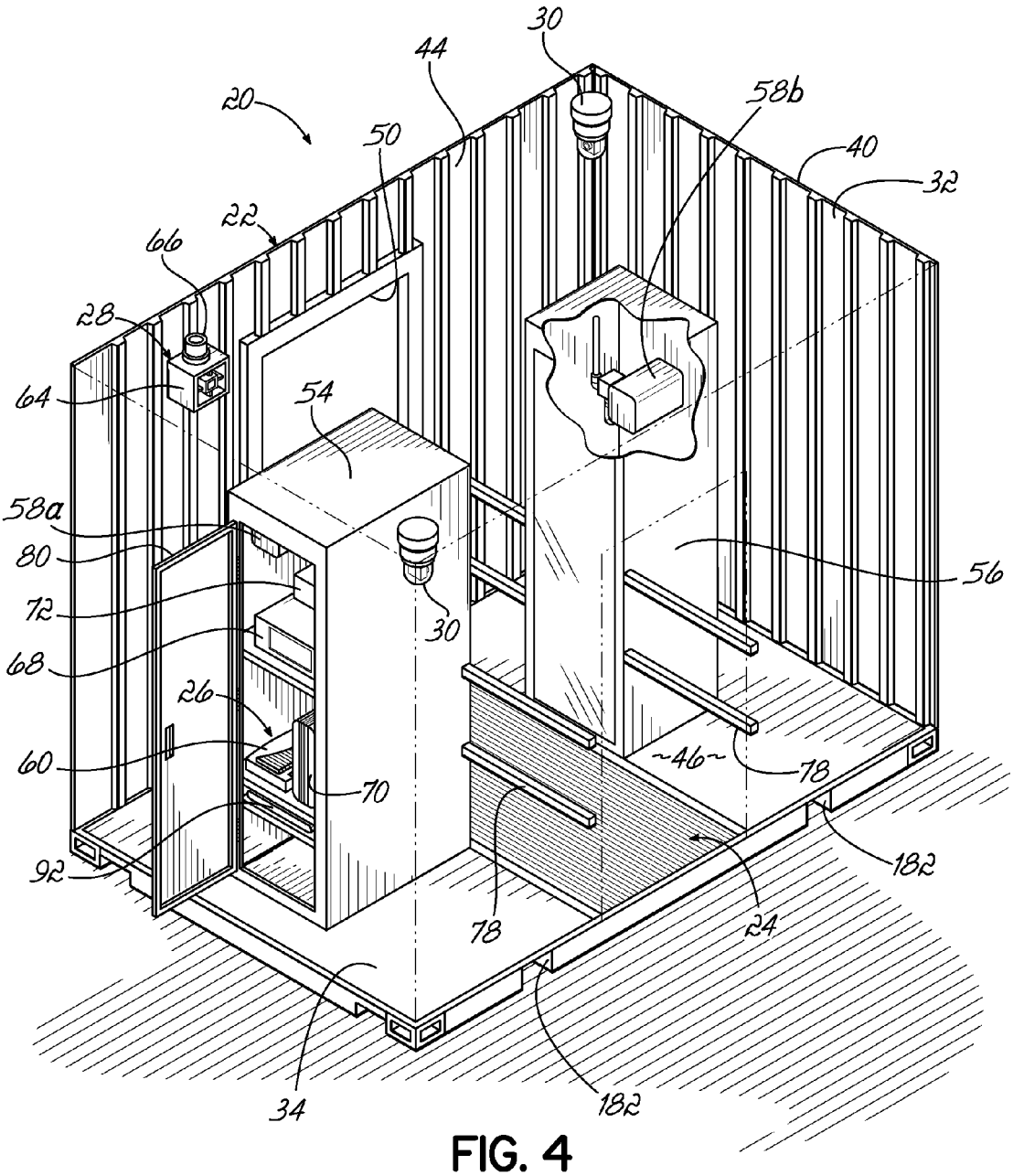
FIG. 4 is a detailed perspective view of the mobile security system of FIG. 2, with walls of the container shown in phantom to illustrate various components of the mobile security system.
Figure 5:
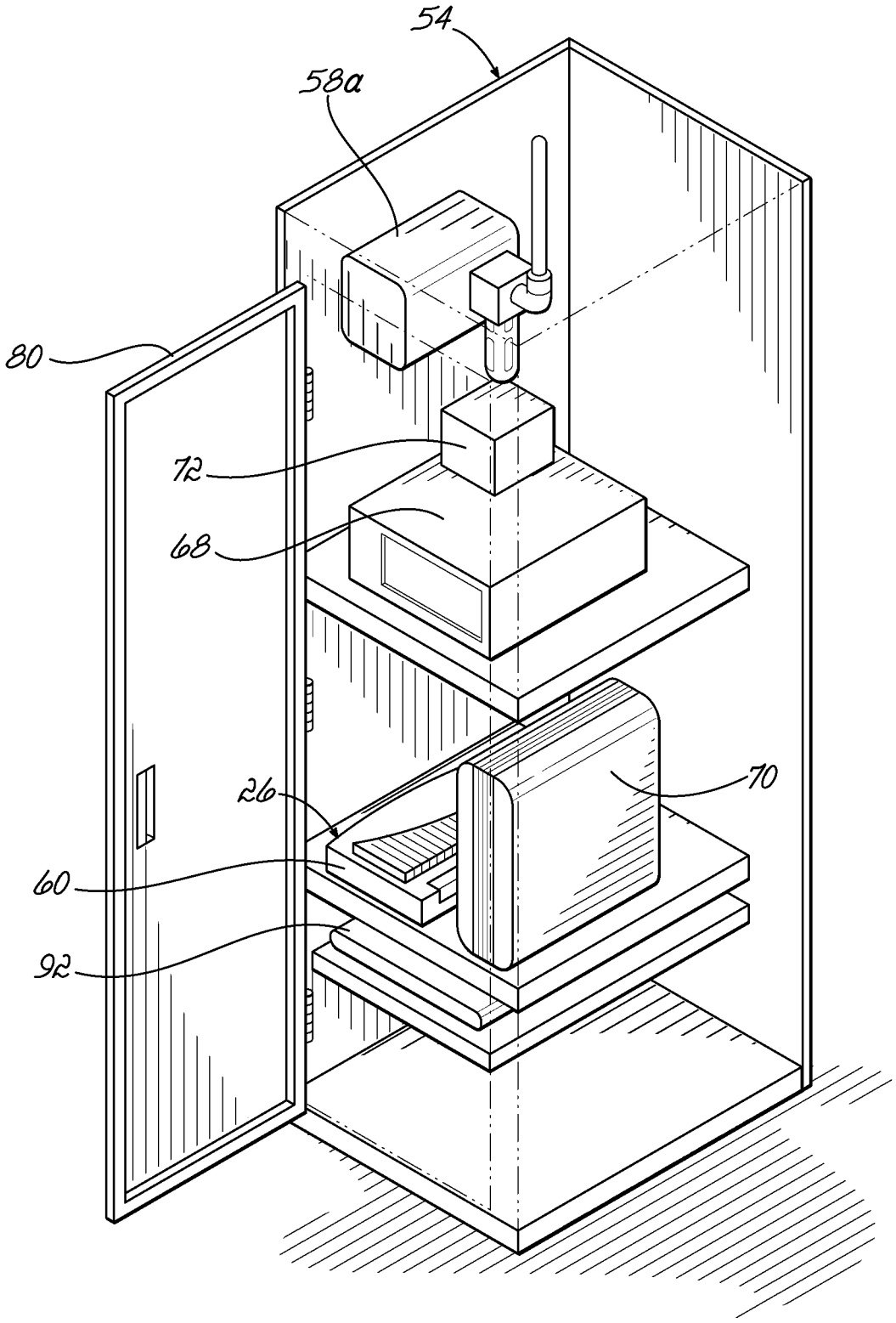
FIG. 5 is a detailed view of one of a cabinet positioned in the container of FIG. 4, partially shown in phantom to illustrate various components held therein.

Referring now to FIGS. 3-5, the mobile security system 20 includes the container 22 as described above. The container 22 includes a housing 32 having a general box-shape including a floor 34, a roof 36, a first end wall 38, a second end wall 40 spaced from the first end wall 38, a first side wall 42 extending between the first and second end walls 38, 40, and a second side wall 44 extending between the first and second end walls 38, 40. The housing 32 encloses an interior 46 configured to receive the electronic components of the mobile security system 20. The walkway 24 extends transversely through the housing 32 from a first door 48 formed in the first side wall 42 to a second door 50 formed in the second side wall 44. To this end, the walkway 24 defines a path through the mobile security system 20 and leading to the exit gate 10 when the container 22 is positioned as shown in FIG. 2. It will be understood that the first and second doors 48, 50 may be normally left open or may be closeable in certain embodiments when the mobile security system 20 is not in active use. The container 22 is rugged enough to protect the RFID and electronic components described below from harsh environmental conditions or vibrational damage during movement of the mobile security system 20.

The mobile security system 20 further includes a RFID detection system 26 positioned within a primary cabinet 54 and a secondary cabinet 56 located adjacent to the walkway 24 on opposing sides of the interior 46 of the container 22. The RFID detection system 26 is embodied as an automatic identification and data capture RFID system. Although the exemplary embodiment shown in the figures illustrates two equipment cabinets 54, 56, the RFID detection system 26 could also be placed in one cabinet or more than two cabinets in other embodiments. As shown in FIGS. 4 and 5, the RFID detection system 26 includes a first RFID antenna 58*a* positioned in the primary cabinet 54 and a second RFID antenna 58*b* positioned in the secondary cabinet 56. Providing multiple RFID antennas 58*a*, 58*b* ensures highly accurate scanning of any person walking through the container 22 at the walkway 24. The RFID detection system 26 also includes a RFID reader 60 positioned within the primary cabinet 54. The RFID antennas 58*a*, 58*b* detect RFID tags passing through the container 22 and communicate this information to the RFID reader 60. The RFID reader 60 then identifies the detected RFID tags and determines whether the identified RFID tag is associated with a jobsite item such as a tool or piece of inventory. Thus, the RFID detection system 26 determines whether any jobsite items tagged with a RFID tag (see FIGS. 7A and 7B, described below) are passing through the mobile security system 20 to the exit gate 10. Also, the RFID detection system 26 requires no additional setup time when the container 22 is positioned in front of an exit gate 10.

The mobile security system 20 also includes an alarm system 28 positioned within the container 22. The alarm system 28 includes at least one siren 64 mounted along one of the walls 38, 40, 42, 44 of the container. The siren 64 is configured to produce an audible signal or alarm noise when a RFID tag associated with a jobsite item has been identified by the RFID detection system 26. The alarm system 28 may also include at least one warning light or strobe light 66 positioned in the interior 46 of the container 22. More particularly, the strobe light 66 may be positioned on the siren 64 as shown in FIG. 4. The strobe light 66 is configured to produce a flashing light or visual indication when a RFID tag associated with a jobsite item has been identified by the RFID detection system 26. More than one siren 64 and strobe light 66 may be provided in other embodiments of the mobile security system 20. Additionally, one or more of the siren 64 and the strobe light 66 may also be mounted on the container 22 outside of the interior 46 to provide an external signal to a person monitoring the exit gate 10.

The mobile security system 20 may further include a computer or central processing unit (CPU) 68 and an uninterruptible power supply (UPS) 70 housed within the primary cabinet 54. The CPU 68 is operatively connected to the RFID detection system 26 and the alarm system 28 and controls the operation of each of these components of the mobile security system 20. To this end, the alarm system 28 may further include a siren relay 72 located adjacent the CPU 68 in the primary cabinet 54. The siren relay 72 is configured to receive actuation signals from the CPU 68 when a RFID tag associated with a jobsite item has been identified by the RFID detection system 26 and thereby cause the actuation of the siren 64 and/or the strobe light 66. The CPU 68 may also be operable to store the database of RFID tags associated with jobsite items on the jobsite and also store photographic evidence of potential unauthorized removals of jobsite items as described in further detail below. The UPS 70 is configured to provide an uninterrupted supply of electrical power to each of the electronic components of the mobile security system 20, including the RFID detection system 26, the alarm system 28, and the CPU 68. The UPS 70 may receive power from appropriate connections near the exit gate 10 and may also have a battery backup in case the jobsite power supply is interrupted. The alarm system 28 may also be configured to emit a different indication signal for a loss of power when the UPS 70 is powering the mobile security system 20 on battery power so that the loss of power may be addressed before the battery drains. One or more cooling units (not shown) may also be provided on the primary cabinet 54 to remove heat generated from the electronic components from the primary cabinet 54.

As shown in FIG. 4, the mobile security system 20 may further include one or more camera devices 30 mounted in the interior 46 of the container 22. In the exemplary embodiment, a camera device 30 is positioned on the roof 36 of the container 22 adjacent the first door 48 and another camera device 30 is positioned on the roof 36 of the container 22 adjacent the second door 50. The camera devices 30 may be IP dome cameras 30 that are activated by motion sensed in the container 22. The camera devices 30 are also operatively coupled to the RFID detection system 26 via the CPU 68. The camera devices 30 capture images of the interior 46 of the container 22 when the RFID detection system 26 identifies that a RFID tag associated with a jobsite item is passing through the container 22 and also capture images when working personnel pass through the container 22 without jobsite items. In this regard, the camera devices 30 operate independently of the RFID detection system 26. The photographs or video evidence captured by the camera devices 30 may then be stored by the CPU 68 for later analysis. Alternatively, the camera devices 30 may continuously record the interior 46 of the container 22 and the resulting video may be time stamped or may be saved in the CPU 68 only when a RFID tag associated with a jobsite item is detected and identified. The camera devices 30 may be closed-circuit cameras or other types of well known IP cameras, as well understood in the security field.

As shown in FIG. 4, the walkway 24 may be bounded on either side by the primary cabinet 54, the secondary cabinet 56, and a railing 78 extending between the cabinets 54, 56 and the first and second side walls 42, 44. The railings 78 are configured to keep people walking through the container 22 in the walkway 24 and away from cabinet doors 80 on the cabinets 54, 56, which face toward the first and second end walls 38, 40 away from the walkway 24. As a further security measure to prevent tampering with the electronic components in the cabinets 44, 46 the cabinet doors 80 are configured to be blocked at least partially from opening by the respective first and second end walls 38, 40. When the container 22 is a standard shipping container, the first and second end walls 38, 40 may be configured as doors that may be opened as well understood in the container field. Thus, the first end wall 38 must be opened to provide clearance to open the cabinet door 80 of the primary cabinet 54. Alternatively, the first and second end walls 38, 40 may not include doors in other embodiments such that the cabinets 54, 56 must be moved to provide clearance for opening the cabinet doors 80. Consequently, during normal operation when the first end wall 38 is closed, the persons walking through the container 22 cannot access the electronic equipment stored within the primary cabinet 54 and the secondary cabinet 56.

Figure 6:
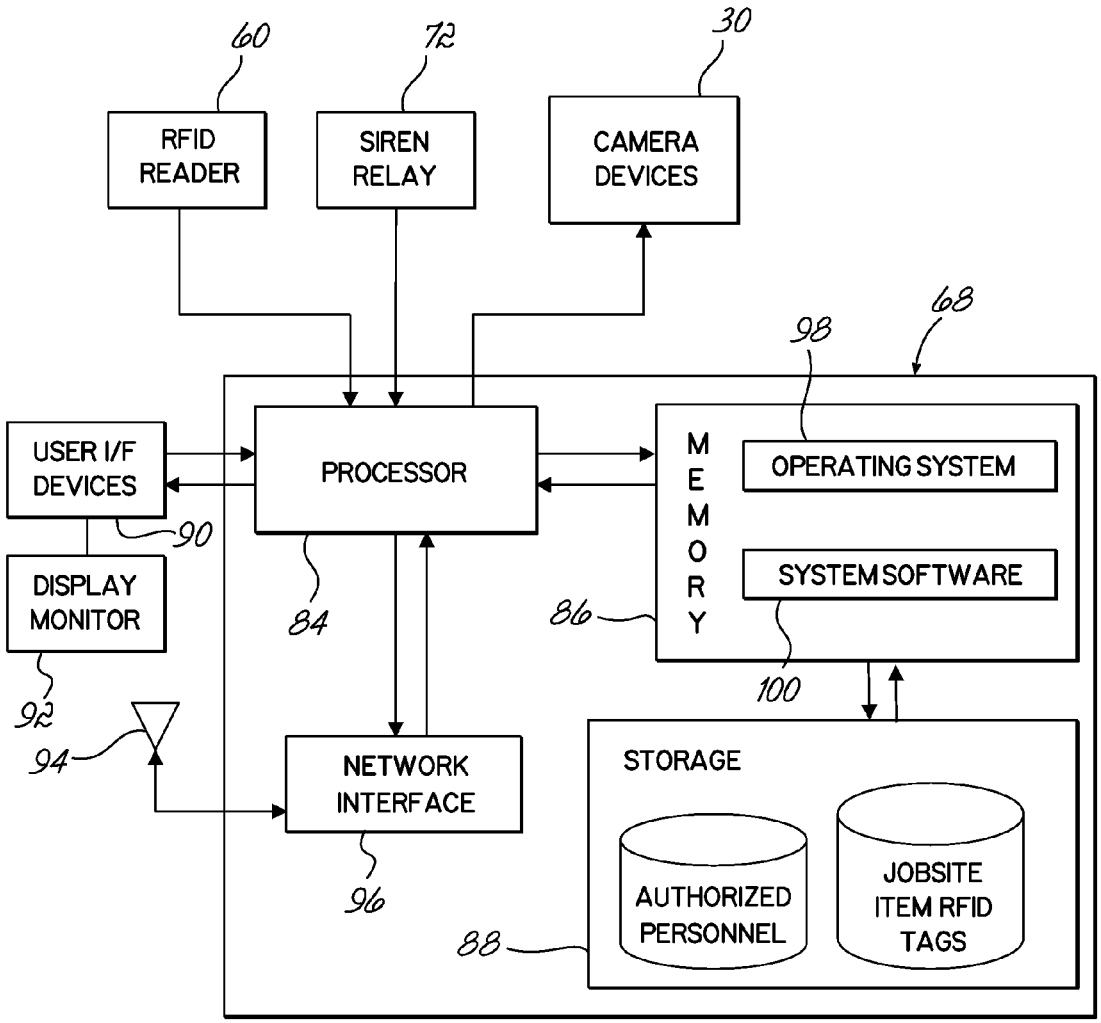
FIG. 6 is a schematic view of the electronic components of the mobile security system of FIG. 2.

The electronic components of the mobile security system 20 are shown schematically in further detail in FIG. 6. In this regard, the CPU 68 typically includes at least one processor 84 coupled to a memory 86. The processor 84 may represent one or more processors (e.g. microprocessors), and the memory 86 may represent the random access memory (RAM) devices comprising the main storage of the CPU 68, as well as any supplemental levels of memory, e.g., cache memories, non-volatile or backup memories (e.g. programmable or flash memories), read-only memories, etc. In addition, the memory 86 may be considered to include memory storage physically located elsewhere in the CPU 68, e.g., any cache memory in a processor 84, as well as any storage capacity used as a virtual memory, e.g., as stored on a mass storage device 88. The mass storage device 88 may contain one or more databases with information related to personnel with authorized access to remove jobsite items from the jobsite as well as a record of every RFID tag associated with a jobsite item for that jobsite.

The CPU 68 also typically receives a number of inputs and outputs from the other components of the mobile security system 20. For interface with a user or operator, the CPU 68 typically includes one or more user interface devices 90, such as input devices (e.g., a keyboard, a mouse, a trackball, a joystick, a touchpad, a keypad, a stylus, and/or a microphone, among others). The interface devices 90 may also include a display or other output device (e.g., a CRT monitor, an LCD display panel, and/or a speaker, among others). In the exemplary embodiment, the interface devices 90 include a display monitor 92 in the primary cabinet 54 as also shown in FIG. 5. When the primary cabinet 54 is opened as described above, the display monitor 92 is configured to display information (i.e., identification of jobsite items and photographic evidence from the camera devices 30) pertaining to RFID tags detected and identified by the RFID detection system 26. Additional inputs and outputs for the CPU 68 may also communicate with the RFID reader 60, the siren relay 72 of the alarm system 28, and the camera devices 30. As well understood, the CPU 68 may also communicate on a wireless network 94 through a network interface 96. In this regard, when a jobsite item is detected by the RFID detection system 26, the CPU may send e-mail or other electronic notification to specified security or management personnel to alert them of the breach in security.

The CPU 68 operates under the control of an operating system 98, and executes or otherwise relies upon various computer software applications, components, programs, objects, modules, data structures, etc. (e.g. system software 100). Under control of the operating system 98 and the system software 100, the processor 84 actuates scans of the interior 46 of the container 22 with the RFID detection system 26 and actuates the alarm system 28 when appropriate. The operation of the mobile security system 20 is explained in further detail with reference to FIGS. 8 and 9, below.

In general, the routines executed to implement the embodiments of the invention, whether implemented as part of an operating system or a specific application, component, program, object, module or sequence of instructions will be referred to herein as "computer program code", or simply "program code". The computer program code typically comprises one or more instructions that are resident at various times in various memory and storage devices in a computer, and that, when read and executed by one or more processors in a computer, causes that computer to perform the steps necessary to execute steps or elements embodying the various aspects of the invention. Moreover, while the invention has and hereinafter will be described in the context of fully functioning computers and computer systems, those skilled in the art will appreciate that the various embodiments of the invention are capable of being distributed as a program product in a variety of forms, and that the invention applies equally regardless of the particular type of computer readable media used to actually carry out the distribution. Examples of computer readable media include but are not limited to physical, recordable type media such as volatile and non-volatile memory devices, floppy and other removable disks, hard disk drives, optical disks (e.g., CD-ROM's, DVD's, etc.), among others, and transmission type media such as digital and analog communication links.

In addition, various program codes described hereinafter may be identified based upon the application or software component within which it is implemented in specific embodiments of the invention. However, it should be appreciated that any particular program nomenclature that follows is merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, APIs, applications, applets, etc.), it should be appreciated that the invention is not limited to the specific organization and allocation of program functionality described herein.

Those skilled in the art will recognize that the exemplary environment illustrated in FIG. 6 is not intended to limit the present invention. Indeed, those skilled in the art will recognize that other alternative hardware and/or software environments may be used without departing from the scope of the invention. Those skilled in the art will also appreciate that the physical requirements of the computing environment may require additional structural support and vibration tolerance due the mounting of the electronic components in a mobile container 22 as shown in FIGS. 3-5. The mobility of the security system 20 may introduce additional shock and vibration type loads not experienced by similar non-mobile configurations. Therefore, the primary and secondary cabinets 54, 56 are arranged with vibration absorbing mounts or materials to reduce the amount of vibrational or movement shock that may be encountered by the electronic components of the mobile security system 20. The secure mounting of the electronic components within the container 22 also ensures that the mobile security system 20 may be moved from one jobsite or exit gate 10 to another without requiring significant set up time. To this end, the mobile security system 20 is a turnkey solution to security needs on a jobsite.

Figure 7A:
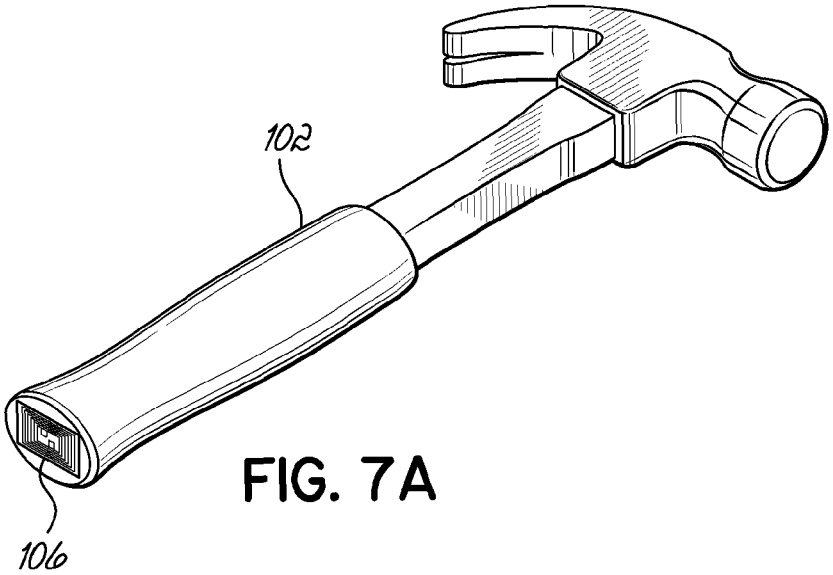
FIG. 7A illustrates an exemplary item with a RFID data tag.
Figure 7B:
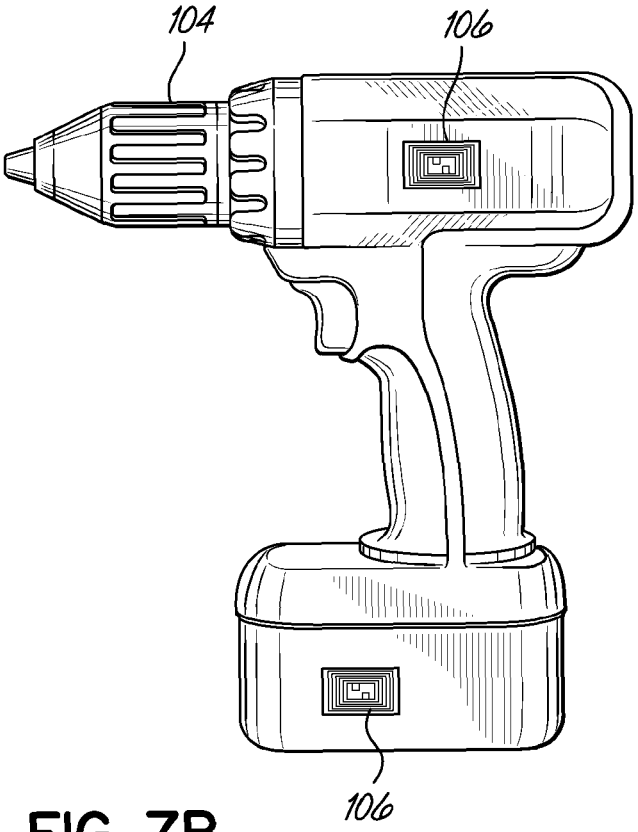
FIG. 7B illustrates an exemplary item with two RFID data tags.

One particular jobsite item that encounters regular theft or unauthorized removal from a jobsite is tools, such as the hammer 102 shown in FIG. 7A and the power drill 104 shown in FIG. 7B. One or more RFID tags 106 are placed on the hammer 102 and the power drill 104 and are associated with these tools by the mass storage device 88 of the CPU 68. For a one-piece tool such as the hammer 102, only one RFID tag 106 may be positioned on the tool. For multi-piece tools such as the power drill 104, one RFID tag 106 may be positioned on each component of the tool to prevent theft of batteries and other important components. Critical pieces of inventory and other parts and components may also be tracked using RFID tags 106, although examples of this are not shown in the figures.

Figure 8:
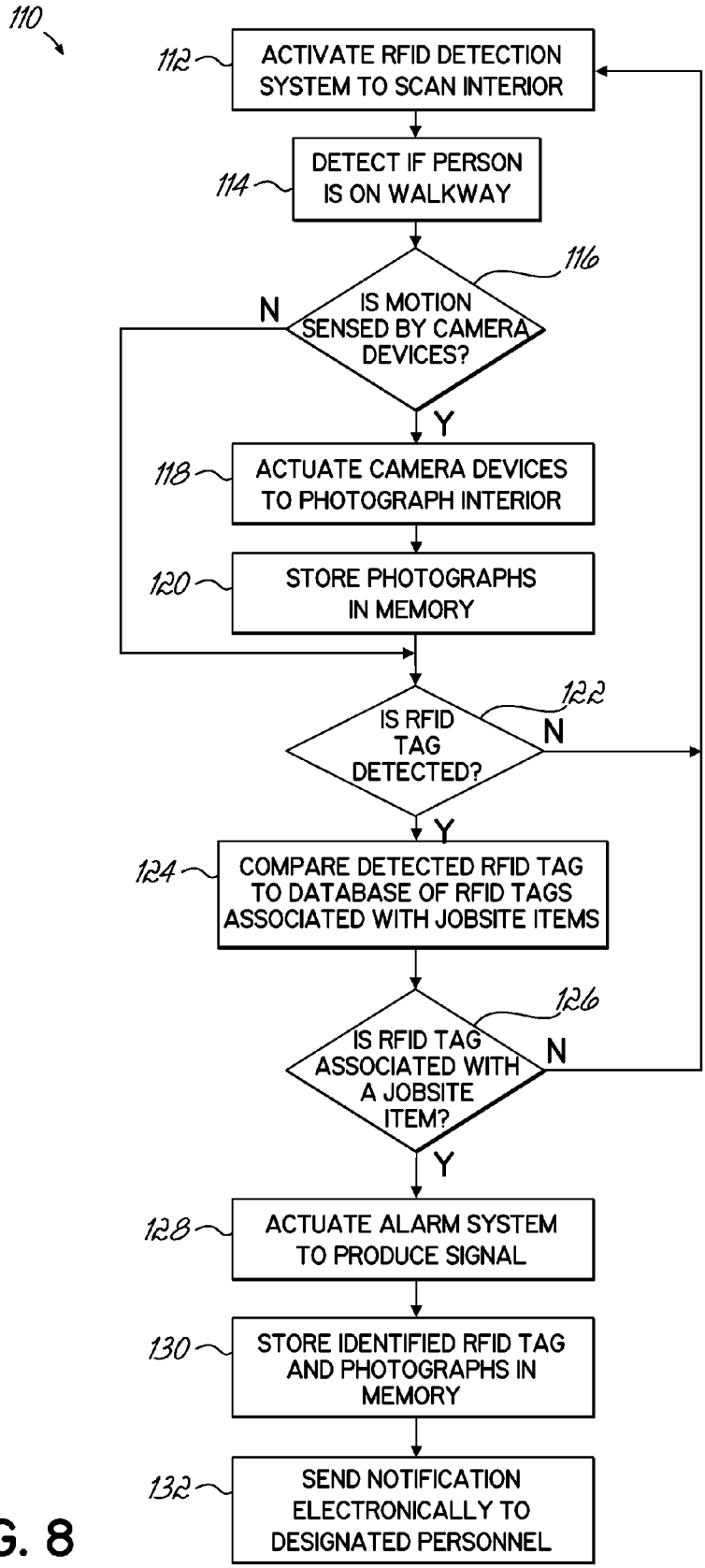
FIG. 8 is a schematic flowchart showing a first exemplary operation of the mobile security system of FIG. 2.

FIG. 8 illustrates a first exemplary operation 110 of the mobile security system 20. The mobile security system 20 begins by activating the RFID detection system 26 to scan the interior 46 of the container 22 (at block 112). The mobile security system 20 then detects if a person is on the walkway (at block 114). More particularly, the camera devices 30 determine if motion is sensed in the container 22 (at block 116). If no motion is sensed, the CPU 68 moves to block 122 described below. If motion is detected, the camera devices 30 are actuated to photograph the interior 46 of the container (at block 118). The photographs are stored in memory 86 (at block 120). The RFID detection system 26 then determines if a RFID tag is present in the container 22 (at block 122). If a RFID tag is not detected, the mobile security system 20 returns to block 112. If a RFID tag is detected, the CPU 68 compares the detected RFID tag to the database of RFID tags stored in the mass storage device 88 and associate with jobsite items (at block 124). The CPU 68 then determines if the detected RFID tag is associated with a jobsite item (at block 126). If the RFID tag is not associated with a jobsite item, the mobile security system 20 returns to block 112. If the RFID tag is associated with a jobsite item, the CPU 68 actuates the alarm system 28 to produce an audible and/or visible signal indicating that an unauthorized removal of a jobsite item is happening (at block 128). The identified RFID tag information and any photographs or video from the camera devices 30 are then stored in memory 86 for later retrieval (at block 130). Notification is then sent electronically via e-mail or other means to designated personnel, such as security personnel or management personnel regarding the unauthorized jobsite item removal, such that appropriate action may be taken quickly (at block 132).

Figure 9:
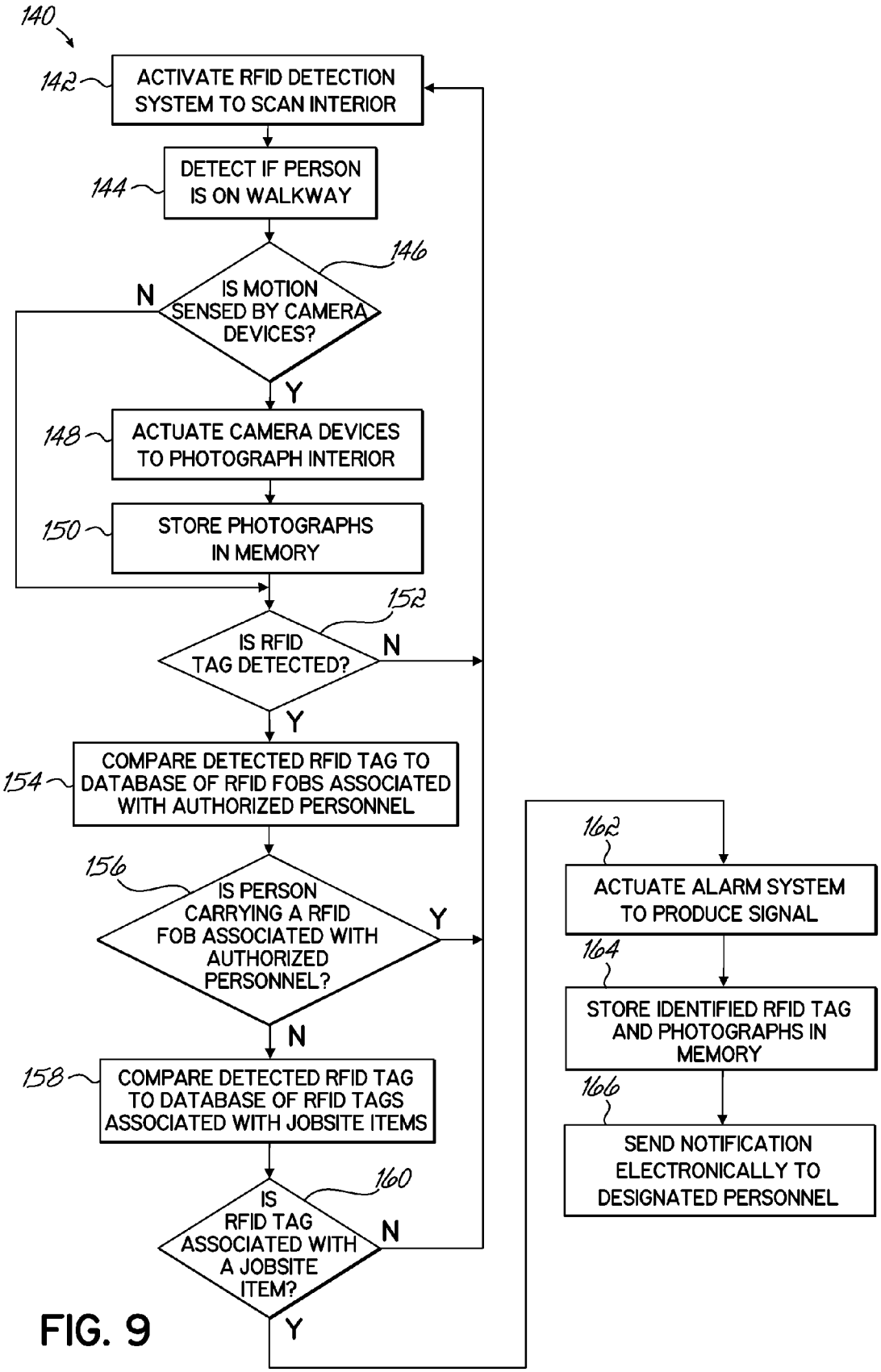
FIG. 9 is a schematic flowchart showing a second exemplary operation of the mobile security system of FIG. 2.

In some embodiments, it may be desirable to permit certain top-level personnel or contractors to leave a jobsite with jobsite items without setting off an alarm. These top-level personnel or authorized persons are provided with RFID key fobs associated with them. Alternatively, the authorized personnel may be provided with RFID cards, RFID tags implanted into a hard hat, or other alternative RFID tags instead of a fob, but in FIG. 9 all these possibilities are described as a RFID fob. FIG. 9 illustrates a second exemplary operation 140 of the mobile security system 20 in this circumstance. The mobile security system 20 begins by activating the RFID detection system 26 to scan the interior 46 of the container 22 (at block 142). The mobile security system 20 then detects if a person is on the walkway (at block 144). More particularly, the camera devices 30 determine if motion is sensed in the container 22 (at block 146). If no motion is sensed, the CPU 68 moves to block 152 described below. If motion is detected, the camera devices 30 are actuated to photograph the interior 46 of the container (at block 148). The photographs are stored in memory 86 (at block 150). The RFID detection system 26 then determines if a RFID tag is present in the container 22 (at block 122). If a RFID tag is not detected, the mobile security system 20 returns to block 142. If a RFID tag is detected, the CPU 68 compares the detected RFID tag with a database of RFID fobs associated with authorized personnel (at block 154). The CPU 68 determines if the detected RFID tag is a RFID fob associated with authorized personnel (at block 156). If the person in the container 22 is carrying a RFID fob associated with authorized personnel, the mobile security system 20 returns to block 142. If the person in the container 22 is not carrying a RFID fob associated with authorized personnel, the CPU 68 compares the detected RFID tag to the database of RFID tags stored in the mass storage device 88 and associate with jobsite items (at block 158). The CPU 68 then determines if the detected RFID tag is associated with a jobsite item (at block 160). If the RFID tag is not associated with a jobsite item, the mobile security system 20 returns to block 142. If the RFID tag is associated with a jobsite item, the CPU 68 actuates the alarm system 28 to produce an audible and/or visible signal indicating that an unauthorized removal of a jobsite item is happening (at block 162). The identified RFID tag information and any photographs or video from the camera devices 30 are then stored in memory 86 for later retrieval (at block 164). Notification is then sent electronically via e-mail or other means to designated personnel, such as security personnel or management personnel regarding the unauthorized jobsite item removal, such that appropriate action may be taken quickly (at block 166). It will be appreciated that various steps shown in the exemplary operations of FIGS. 8 and 9 may be combined or omitted in various operational embodiments and reordered as necessary.

Figure 10:
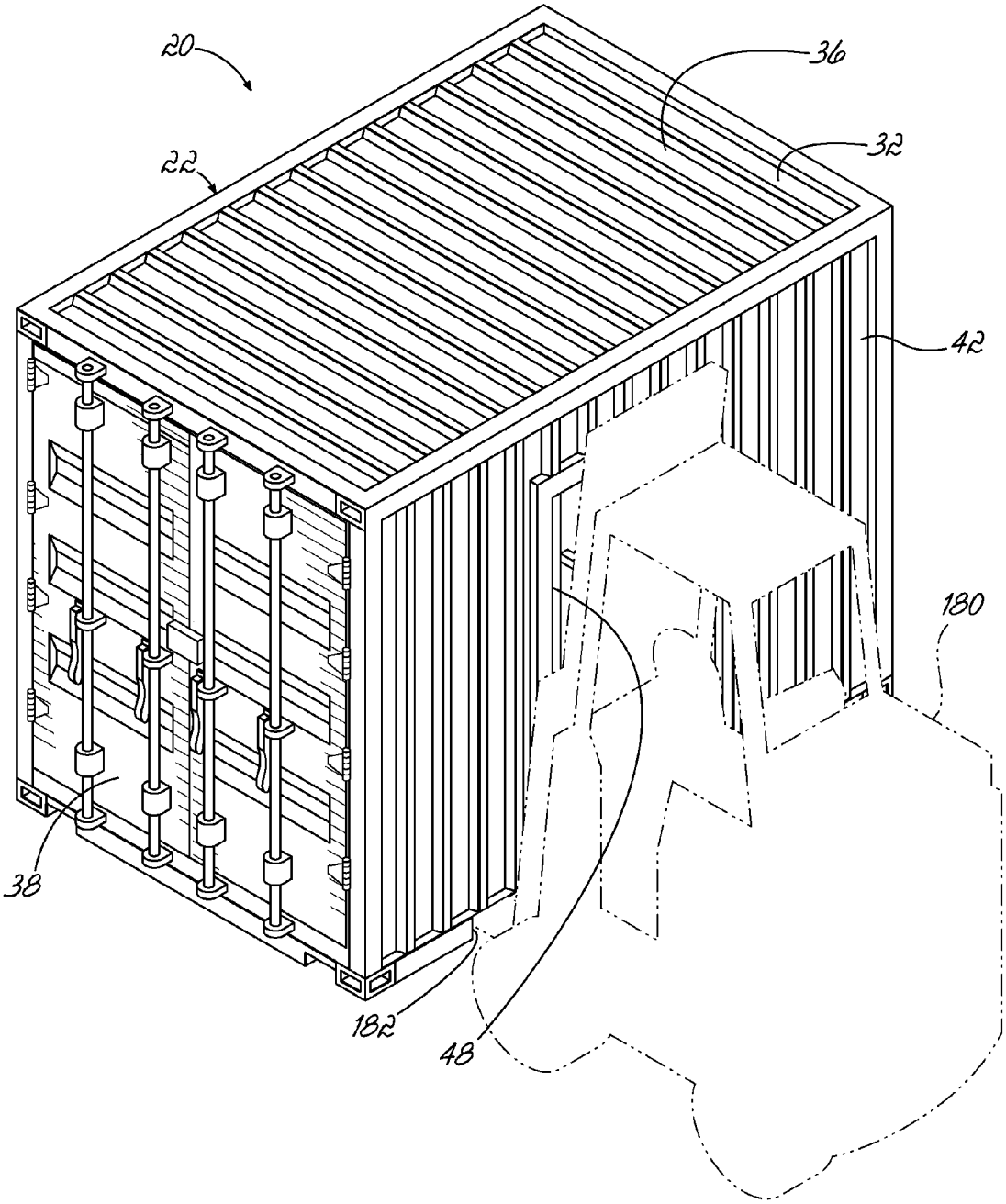
FIG. 10 is a perspective view of the mobile security system of FIG. 2 being moved by a standard forklift device shown in phantom.

As discussed above, the mobile security system 20 is configured for wholesale movement and turnkey placement in front of an exit gate 10 of a jobsite or other controlled space. When the container 22 is a standard shipping container as in the exemplary embodiment, a standard forklift 180 may be used to move the mobile security system 20 as shown in FIG. 10. The container 22 includes fork pockets 182 configured to receive the arms of the standard forklift 180 when the forklift 180 moves the container 22. Alternatively, the container 22 may include lifting lugs (not shown) mounted on the top of the container 22 such that a crane may move the container 22 into and out of position on a jobsite. Other methods of moving the container 22 with loading or moving equipment is also possible. This enables the mobile security system 20 to be readily moved and positioned as security needs change with a jobsite. Furthermore, the ruggedized mounting of the electronic components within the primary cabinet 54 ensures that no damage is done to the mobile security system 20 in the process of moving and positioning the container 22. Additionally, no significant set up time is necessary as the mobile security system 20 is a drop-and-operate type system. Moreover, the electronic components of the mobile security system 20 are fully insulated from the harsh environmental conditions present at many jobsites. To this end, the mobile security system 20 is a comprehensive, durable, and mobile security solution for plant owners, contractors, equipment rental companies, military, and other industries.

Figure 11:
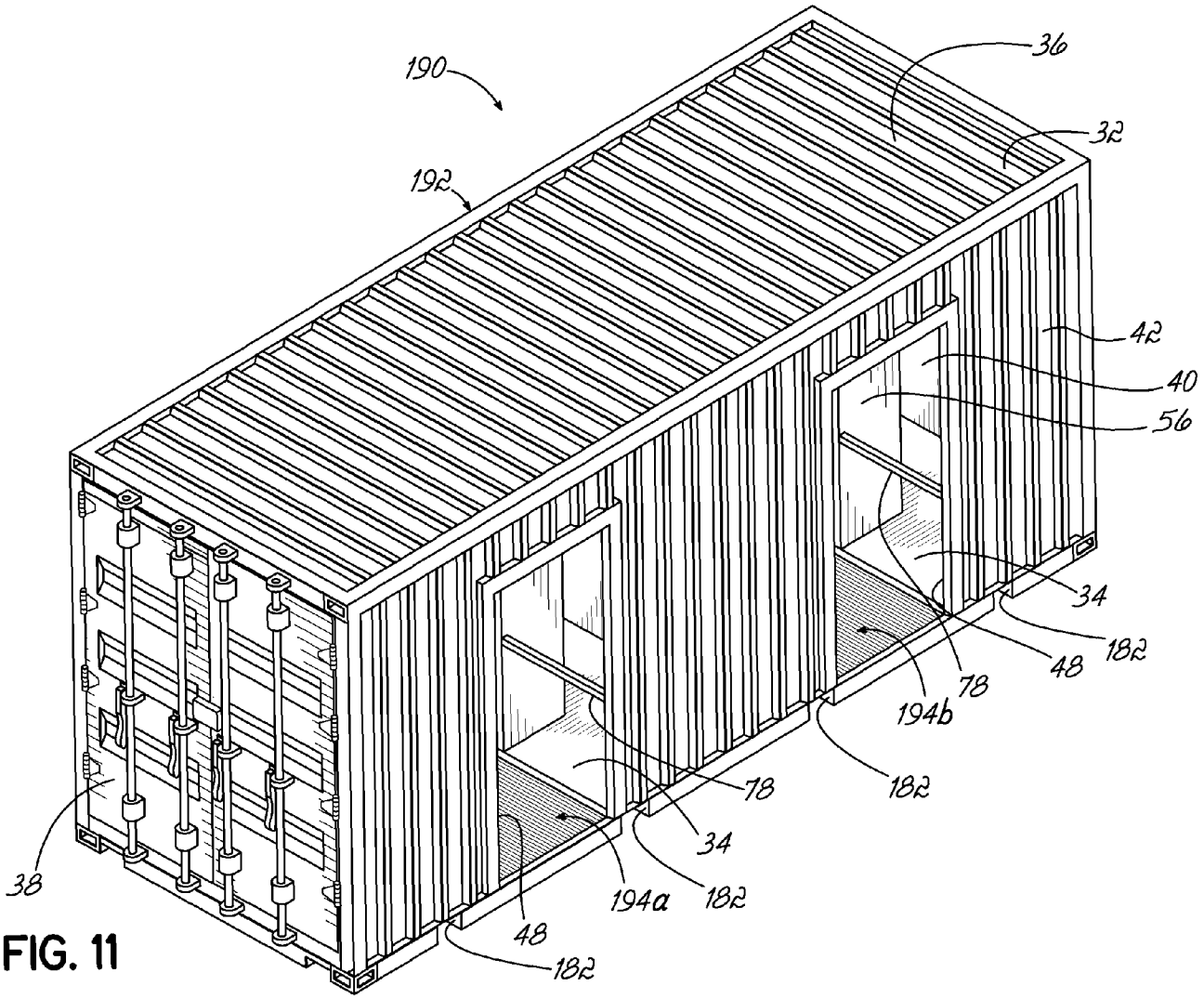
FIG. 11 is a perspective view of another exemplary embodiment of a mobile security system in accordance with the present invention.

FIG. 11 shows an alternative embodiment of the mobile security system 190. Whereas the mobile security system 20 of the first embodiment included one walkway 24 extending through a 10-foot shipping container 22, the mobile security system 190 of this embodiment is housed in a 20-foot shipping container 192. Additionally, the mobile security system 190 now includes two walkways 194*a*, 194*b* extending transversely through the shipping container 192. In other non-illustrated embodiments, the mobile security system may be provided in longer shipping containers such as 30-foot to 40-foot containers with more than two walkways there through. In these alternative embodiments, RFID screening or shielding material may be positioned between the different walkways 194*a*, 194*b* such that RFID tag detection may be correlated to a specific walkway 194*a*, 194*b* such that photographic evidence may be accurately used to stop the perpetrator. The RFID screening or shielding may be a Faraday cage-like screen material made of steel, aluminum, or another material operable to occlude RFID waves from traveling between walkways 194*a*, 194*b*. However, these RFID screens or shields may be omitted in some embodiments. In any of these embodiments, the mobile security system is fully mobile and easily moved between exit gates 10 and between jobsites. When in position, these mobile security systems effectively reduce or prevent theft or unauthorized removal of jobsite items such as tools, equipment, and inventory.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A mobile security system for a jobsite having a plurality of jobsite items, comprising:

a container configured to be moved to a plurality of locations, the container including a housing having first and second end walls and first and second side walls extending between the first and second end walls, an interior within the housing, and a walkway configured to define a path through the container and extending transversely through the housing, the walkway connecting a first door disposed at the first side wall and a second door disposed at the second wall;

a radio frequency identification (RFID) detection system associated with the container, the RFID detection system including at least one RFID antenna configured to detect a plurality of first RFID tags passing through the walkway of the container, each of the plurality of first RFID tags being associated with one of a plurality of jobsite items located at the jobsite, and a RFID reader configured to identify one of the plurality of first RFID tags that are detected by the at least one RFID antenna;

an alarm system associated with the container and producing a visible and/or audible signal when one of the plurality of first RFID tags is identified by the RFID reader;

an uninterruptible power supply (UPS) associated with the container and operable to provide power to the RFID detection system and the alarm system;

a central processing unit (CPU) operatively coupled to the alarm system and the RFID detection system, the CPU configured to actuate the alarm system when an unauthorized removal of a jobsite item carrying the detected RFID tag is identified by the RFID detection system, wherein the CPU includes a memory and a processor, the memory including a database of first RFID indicators stored therein, the first database of indicators associated with the plurality of first RFID tags; and a database of second RFID indicators stored in the memory, the database of second RFID indicators associated with one or more second RFID tags, wherein the second RFID tags are configured to not actuate the alarm system during detection of one of the plurality of first RFID tags by RFID detection system;

wherein the container further includes a primary cabinet positioned along a first side of the walkway in the interior of the container, the primary cabinet containing at least one RFID antenna, the RFID reader, and the UPS, the primary cabinet being sealed from intrusion from the walkway;

wherein the first end wall is openable to provide access into the primary cabinet, wherein the primary cabinet includes a primary cabinet door at least partially blocked from opening by the first end wall when closed; and wherein the primary cabinet also contains a display monitor operatively connected to the RFID detection system and configured to display information about RFID tags identified by the RFID reader.

2. The mobile security system of claim 1, further comprising: a network interface operatively coupled to the RFID detection system and configured to send notification electronically to designated personnel when a RFID tag associated with a jobsite item is identified by the RFID reader.

3. The mobile security system of claim 2, wherein the alarm system further includes a siren positioned in the interior or exterior of the container, a strobe light positioned in the interior or exterior of the container, and a siren relay operatively coupled to the siren, the strobe light, and the CPU.

4. The mobile security system of claim 1, wherein the container further includes a secondary cabinet positioned along a second side of the walkway in the interior of the container, the secondary cabinet containing at least one RFID antenna, the secondary cabinet being sealed from intrusion from the walkway.

5. The mobile security system of claim 1, wherein the second end wall is openable to provide access into the secondary cabinet, wherein the secondary cabinet includes a secondary cabinet door at least partially blocked from opening by the second end wall when closed.

6. A mobile security system for a jobsite having a plurality of jobsite items, comprising:

a container configured to be moved to a plurality of locations, the container including a housing having first and second end walls and first and second side walls extending between the first and second end walls, an interior within the housing, and a walkway configured to define a path through the container and extending transversely through the housing, the walkway connecting a first door disposed at the first side wall and a second door disposed at the second wall;

a radio frequency identification (RFID) detection system associated with the container, the RFID detection system including at least one RFID antenna configured to of first RFID tags passing through the walkway of the container, each of the plurality of first RFID tags being associated with one of a plurality of jobsite items located at the jobsite, and a RFID reader configured to identify one of the plurality of first RFID tags that are detected by the at least one RFID antenna;

an alarm system associated with the container and producing a visible and/or audible signal when one of the plurality of first RFID tags is identified by the RFID reader;

an uninterruptible power supply (UPS) associated with the container operable to provide power to the RFID detection system and the alarm system;

a central processing unit (CPU) operatively coupled to the alarm system and the RFID detection system, the CPU configured to actuate the alarm system when an unauthorized removal of a jobsite item carrying the detected RFID tag is identified by the RFID detection system, wherein the CPU includes a memory and a processor, the memory including a database of first RFID indicators stored therein, the first database of indicators associated with the plurality of first RFID tags; and a database of second RFID indicators stored in the memory, the database of second RFID indicators associated with one or more second RFID tags, wherein the second RFID tags are configured to not actuate the alarm system during detection of one of the plurality of first RFID tags by RFID detection system; and further comprising one or more camera devices operatively coupled to the RFID detection system and configured to capture images of the interior of the container when motion is sensed in the container.

7. The mobile security system of claim 1, wherein the container is a shipping container including more than one walkway extending through the first and second side walls.

8. A mobile security system for a jobsite having a plurality of jobsite items, comprising:

a container configured to be moved to a plurality of locations, the container including a housing having first and second end walls and first and second side walls extending between the first and second end walls, an interior within the housing, and a walkway configured to define a path through the container and extending transversely through the housing, the walkway connecting a first door disposed at the first side wall and a second door disposed at the second wall;

a radio frequency identification (RFID) detection system associated with the container, the RFID detection system including at least one RFID antenna configured to detect a plurality of first RFID tags passing through the walkway of the container, each of the plurality of first RFID tags being associated with one of a plurality of jobsite items located at the jobsite, and a RFID reader configured to identify one of the plurality of first RFID tags that are detected by the at least one RFID antenna;

an alarm system associated with the container and producing a visible and/or audible signal when one of the plurality of first RFID tags is identified by the RFID reader;

an uninterruptible power supply (UPS) associated with the container and operable to provide power to the RFID detection system and the alarm system;

a central processing unit (CPU) operatively coupled to the alarm system and the RFID detection system, the CPU configured to actuate the alarm system when an unauthorized removal of a jobsite item carrying the detected RFID tag is identified by the RFID detection system, wherein the CPU includes a memory and a processor, the memory including a database of first RFID indicators stored therein, the first database of indicators associated with the plurality of first RFID tags; and a database of second RFID indicators stored in the memory, the database of second RFID indicators associated with one or more second RFID tags, wherein the second RFID tags are configured to not actuate the alarm system during detection of one of the plurality of first RFID tags by RFID detection system; and a set of instructions stored in the memory and executable by the processor to detect one of the first and second RFID tags passing through the container, compare the detected one of the first and second RFID tags to the first database of RFID indicators, compare the detected one of the first and second RFID tags to the second database of RFID indicators, determine if the detected one of the first and second RFID tags corresponds to one of the plurality of jobsite items, determine if the detected one of the first and second RFID tags corresponds to personnel authorized to remove the jobsite item from the container, and trigger the alarm system when the detected one of the first and second RFID tags is associated with one of the plurality of jobsite items and is not associated with an authorized personnel.

9. The mobile security system of claim 8, wherein the set of instructions is executable by the processor to activate the RFID detection system, detect any movement along the walkway, and actuate a camera device to photograph the interior of the housing when movement is detected.

10. The mobile security system of claim 9, wherein the set of instructions is executable by the processor to store the photograph in the memory of the CPU.

11. The mobile security system of claim 8, wherein the plurality the first RFID tags is configured to identify a plurality of multi-piece tools each multi-piece tool having a first component identified by one of the first RFID tags and a second component identified by another of the first RFID tags.

* * * * *